US006397390B1

(12) United States Patent
Henderson et al.

(10) Patent No.: US 6,397,390 B1
(45) Date of Patent: Jun. 4, 2002

(54) GARMENT FOR COMMUNICATING THROUGH REMOVABLE MESSAGES

(75) Inventors: Juan Derrick Henderson, Alexandria, VA (US); Joaquina D. Greene, Chevy Chase, MD (US)

(73) Assignee: American Speech-Language-Hearing Association, Rockville, MD (US)

( * ) Notice: Subject to any disclaimer, the term of this patent is extended or adjusted under 35 U.S.C. 154(b) by 0 days.

(21) Appl. No.: 09/971,660

(22) Filed: Oct. 9, 2001

(51) Int. Cl.[7] ..... A41D 1/00
(52) U.S. Cl. ..... 2/69; 2/115; 40/586
(58) Field of Search ..... 2/69, 227, 238, 2/113–115, 228, 105, 106, 108, 94, 85, 93, 171, 244, 246, 209, 13; 40/586

(56) References Cited

U.S. PATENT DOCUMENTS

| | | | | | |
|---|---|---|---|---|---|
| 2,647,261 | A | * | 8/1953 | Rassner | 2/100 |
| 4,650,219 | A | * | 3/1987 | Sigman | 40/586 |
| 4,875,237 | A | * | 10/1989 | Cohen | 2/115 X |
| 4,947,867 | A | * | 8/1990 | Keeton | 40/586 |
| 4,969,214 | A | * | 11/1990 | Cohen | 2/115 X |
| 5,023,130 | A | | 6/1991 | Simpson et al. | 442/408 |
| 5,054,123 | A | * | 10/1991 | Helms | 2/12 |
| 5,423,139 | A | * | 6/1995 | Feldman | 40/586 |
| 5,581,815 | A | * | 12/1996 | Hans | 2/244 |
| 5,632,044 | A | * | 5/1997 | Sloot | 2/102 |
| 5,745,918 | A | | 5/1998 | Shukla et al. | 2/144 |
| 5,794,267 | A | * | 8/1998 | Wallace | 2/227 |
| 5,918,316 | A | * | 7/1999 | Nathanson et al. | 2/244 |
| 5,943,697 | A | * | 8/1999 | Poskanzer | 2/69 |
| 6,061,827 | A | | 5/2000 | Lampson et al. | 2/49.1 |

OTHER PUBLICATIONS

"A History of the Paper Dress", MPH Poster Dress Collection 1999, www.mph–nyc.com, Aug.1, 2001.

* cited by examiner

*Primary Examiner*—Gloria M. Hale
(74) *Attorney, Agent, or Firm*—George T. Marcou; Kilpatrick Stockton LLP

(57) ABSTRACT

An article for communicating at least one message which includes a garment, at least one detachable message, and a securing mechanism for detachably adhering the at least one detachable message to the garment. The securing mechanism is selected from a perforated segment, a snap, Velcro, a button, a magnet, electrostatic forces, a rubber adhesive, and an acrylic adhesive. The garment is formed of a disposable material such as paper or a webbed material or a non-disposable material such as cotton, polyester, spandex, a combination thereof, or the like. Similarly, the at least one detachable message is alternately formed of with a disposable or non-disposable material.

17 Claims, 7 Drawing Sheets

GARMENT FOR COMMUNICATING THROUGH REMOVABLE MESSAGES

BACKGROUND OF THE INVENTION

1. Field of Invention

The subject matter of the present application is directed generally to garments which are used for communication purposes. More particularly, the present invention is directed to garments which contain removable messages for communicating with others.

2. Description of Related Art

The ability to communicate with others is essential to becoming integrated into society. Communication drives every facet of human interaction. For some individuals, such as those with speech, hearing, vision, and/or other disabilities, that may hinder or slow their ability to communicate with society in general, it is helpful to identify new and different ways of communicating in order to bridge any communication gaps. Further, many individuals are shy and introverted, preferring not to speak, but wishing to communicate directly with others nonetheless.

Conventional methods of non-verbal communication include non-verbal gesturing (e.g., sign language) or written communication. For example, many individuals who have difficulty hearing and/or speaking choose to communicate using sign language. While this is a very advanced and useful way of communicating, it is limited to those who have learned to sign. Individuals also communicate through writing letters, notes, etc. This form of communication requires the ability to write. Finally, there are methods of one-to-many communication, such as wearing garments (e.g., hats and shirts) which include written expressions or pictures, and conversely random communications to one individual, such as messages within fortune cookies. These written expressions or pictures relay a non-verbal message to anyone who sees and/or reads the garment, such as, what professional sports team the wearer enjoys, what college or university the wearer attended, and even messages about the wearer's political views. The conventional one-to-many non-verbal communication through a garment is not personalized because everyone receives the same message. In the random communication to one individual scenario, i.e., fortune cookies which contain non-verbal messages, the messages are not sent from one individual to at least one other individual. The message that is received is random, not personalized.

In alternative embodiments of the present invention, the securing mechanism is a perforated segment, a snap, Velcro™ (i.e., a hook and loop fastener), a button, a magnet, electrostatic forces, a rubber adhesive, or an acrylic adhesive.

SUMMARY OF THE INVENTION

The present invention comprises an article for communicating at least one message which includes a garment, at least one detachable message, and a securing mechanism for detachably adhering the at least one detachable message to the garment.

In alternative embodiments of the present invention, the securing mechanism is a perforated segment, a snap, Velcro™ (hook or loop fastener), a button, a magnet, electrostatic forces, a rubber adhesive, or an acrylic adhesive.

In a further embodiment of the present invention, the garment is formed of a disposable material such as paper, Tyvek®, Sontara®, or a webbed material.

In yet a further embodiment of the present invention, the garment is formed of a non-disposable material such as cotton, polyester, spandex, a combination thereof, or the like.

In still a further embodiment of the present invention, detachable messages in the form of garment pieces are formed of the same material as the garment.

In still a further embodiment of the present invention, the garment comprises a shirt, a hat, a jacket, a vest, a fashion accessory or the like.

DETAILED DESCRIPTION OF THE PREFERRED EMBODIMENTS

Figure 1:
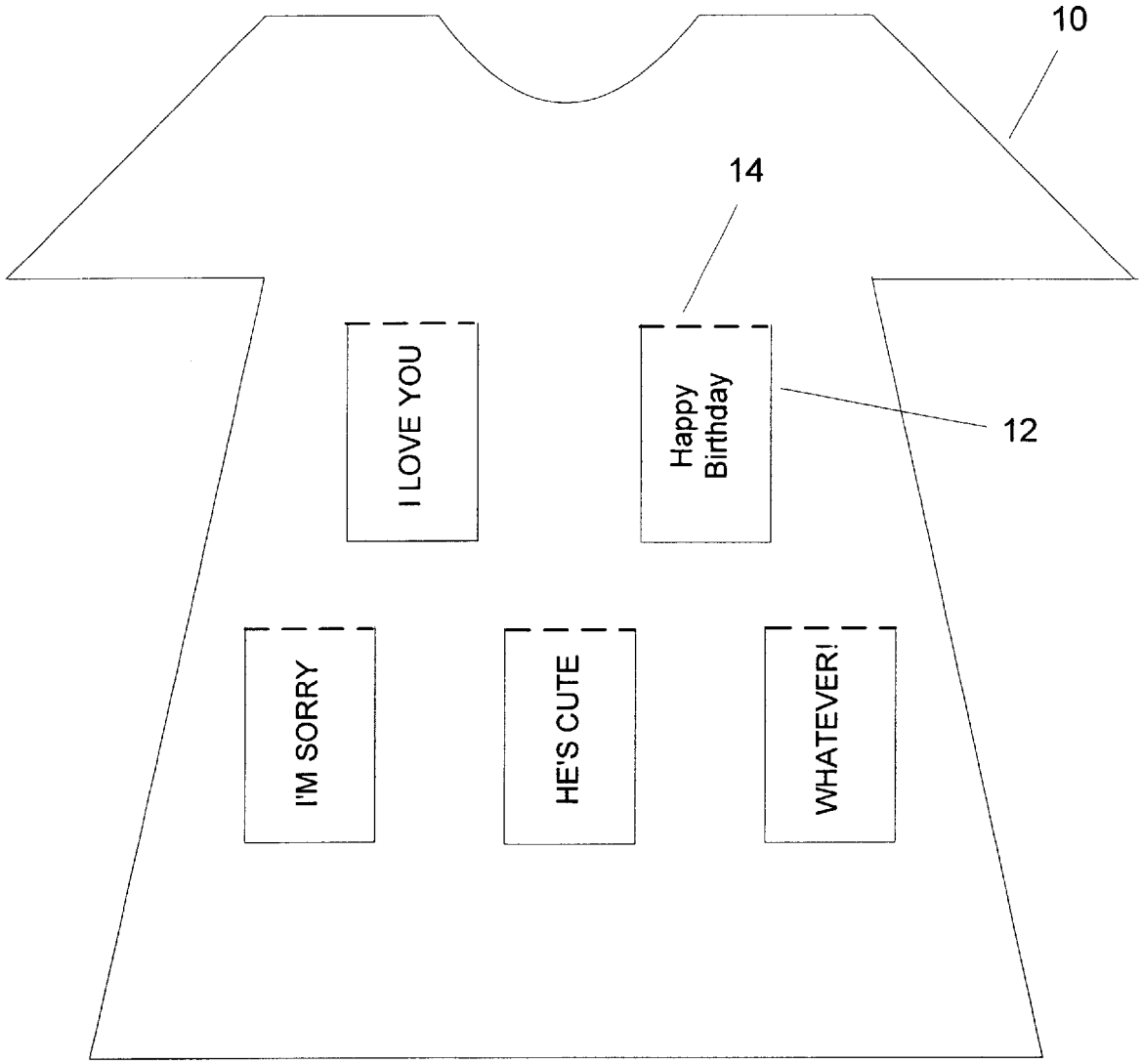
FIG. 1 depicts a garment containing removable garment pieces according to an embodiment of the present invention.

In a first embodiment of the present invention, referring to FIG. 1 a garment 10, in this particular embodiment a shirt, is formed of a material such as, paper, Tyvek®, Sontara®, or a webbed material such as that described in U.S. Pat. No. 5,023,130, in a particular manner, so as to allow the wearer to remove pieces 12 of the garment. More particularly, in this example, each piece 12 is removably attached to the garment via a temporary securing mechanism 14. In alternate embodiments described below, the securing mechanism 14 comprises one or more of the following: a series of perforations, Velcro™ (i.e., a hook and loop fastener), snaps, ties, buttons, magnets, plastic-on-plastic (i.e., friction) or other temporary adherents which temporarily and removably secure the pieces 12 to the garment 10. Other temporary adhesives include: pressure-sensitive adhesives such as tackified rubber adhesives, such as natural rubber, olefins, silicones, polyisoprene, polybutadiene, polyurethanes, styrene-isoprene-styrene and styrene-butadiene-styrene block copolymers, and other elastomers; and tackified or untackified acrylic adhesives such as copolymers of isooctylacrylate and acrylic acid, which can be polymerized by radiation, solution, suspension, or emulsion techniques. Crosslinked adhesives are preferred, especially those pressure-sensitive adhesives crosslinked to give high shear strengths. The most preferred adhesives are those that are crosslinked by radiation with or without a chemical crosslinking agent. Such adhesives that have high shear strength provide low debonding force and can easily be removed when stretched.

Further to FIG. 1, the communication garment 10 and the pieces 12 are formed of the same material. Further, the material is disposable. For example, the communication garment is formed of a paper-like material or other disposable material such as Tyvek®, Sontara®, or a webbed material such as that described in U.S. Pat. No. 5,023,130, which is incorporated herein by reference in its entirety. In FIG. 1, the garment pieces are secured to the garment on only one of four sides by a perforation segment. Alternatively, the garment pieces are secured on more than one side, or in more than one place. In the exemplary embodiments shown in FIGS. 1–7, the removable garment pieces 12 contain written or printed messages which include one or more symbols, letters, phrases, symbols, etc. The garment pieces 12 are removable and thus transferable to another individual. For example, the wearer of the garment, wishing to communicate to another individual that he or she is sorry, removes the garment piece stating, "I'M SORRY," and either hands it or shows it to another individual. The remaining garment pieces include any number of other communicative messages. In alternative embodiments, the messages are letters, wherein multiple messages are used to form a single letter, word, phrase or symbols such as hearts, peace signs, stars, or any other symbol. Further, the letters and phrases need not be in English, but may be in any language. The number and predetermined pattern of the garment pieces are unlimited. In this first embodiment, when the garment pieces are removed, there is a remaining hole in the garment where the removed garment piece was located. In an alternative embodiment, the garment is manufactured such that upon removable of a garment piece, there is actually a layer of material beneath where the removable garment piece was located, so as to maintain the integrity of the garment.

Figure 2A:
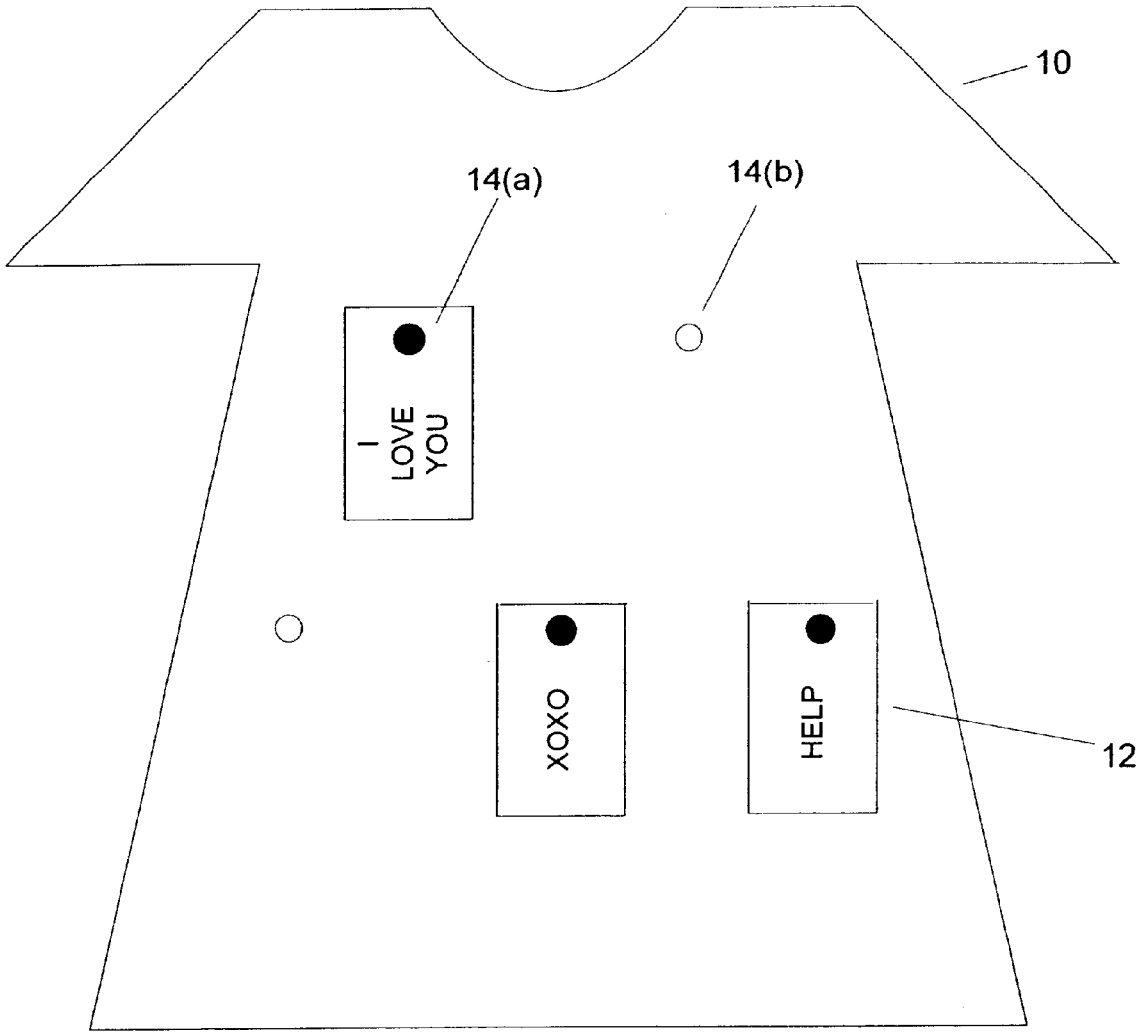
FIGS. 2(*a*)–2(*b*) depict a garment containing removable garment pieces and a garment piece having part of a securing mechanism according to an embodiment of the present invention.
Figure 2B:
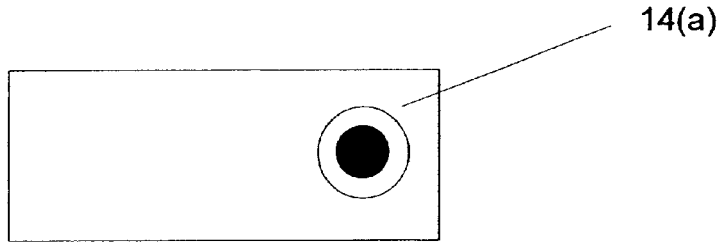

Referring to FIGS. 2(*a*), (*b*), 3(*a*), (*b*), 6(*a*), (*b*), and 7, in a second embodiment, neither the communication garment nor the garment pieces are formed of disposable materials. In this embodiment, the garment is made from known textile materials, such as cotton, polyester, spandex, some blended combination thereof, or like. Suitable textile materials are known to those skilled in the art and will not be discussed further herein. Arranged in a predetermined pattern, the garment pieces containing communicative messages are attached to the garment via, for example, snaps, Velcro™ (i.e., a hook and loop fastener), loops and ties., magnets, electrostatic forces, buttons, or equivalents thereof. As shown in FIG. 2(*a*), the securing mechanism is comprised of snap and requires two snap parts 14(*a*) and 14(*b*). FIG. 2(*b*) illustrates snap portion 14(*a*) from attaching side garment piece.

Figure 3A:
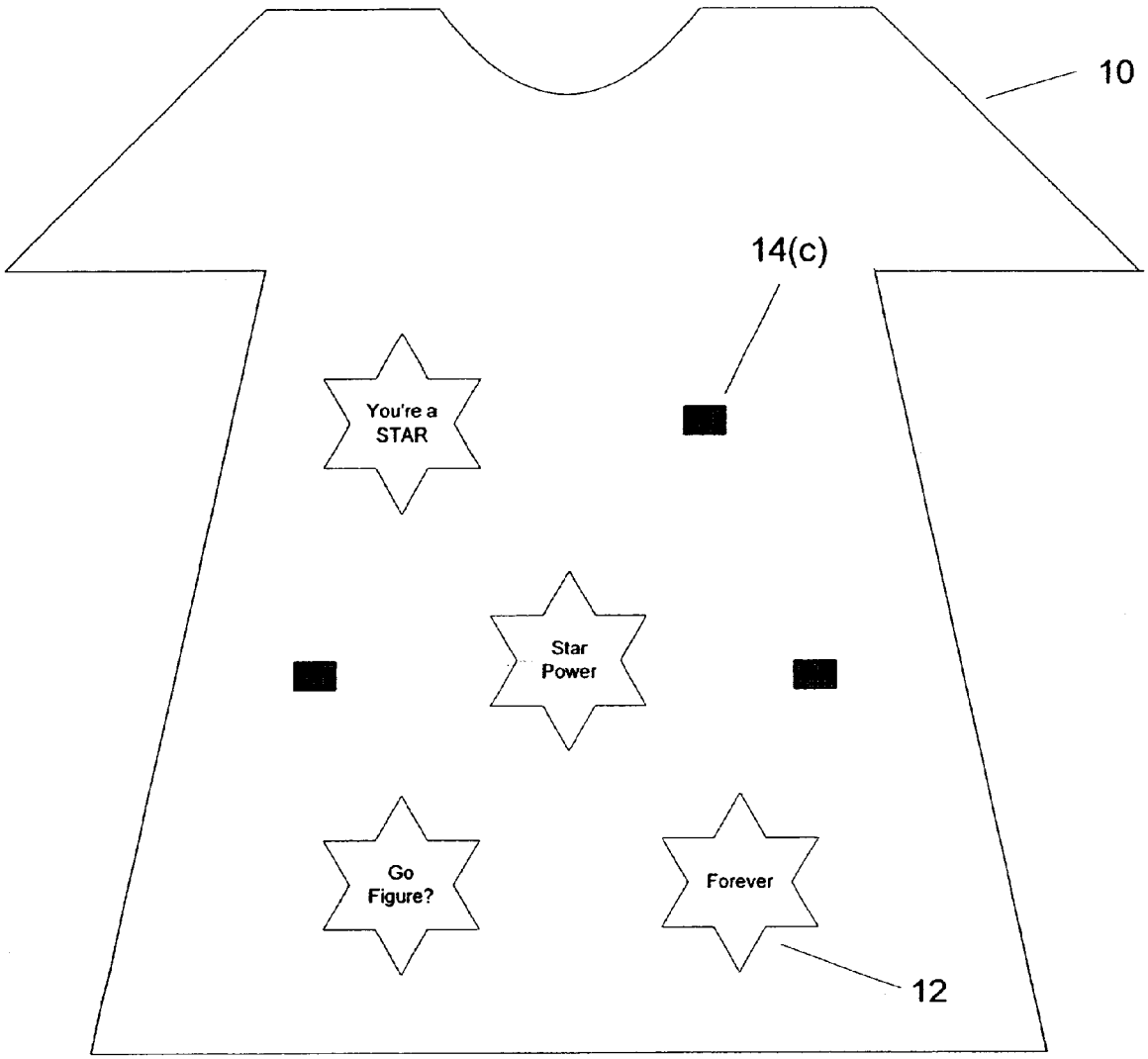
FIGS. 3(*a*)–3(*b*) depict a garment containing removable garment pieces and a garment piece having part of a securing mechanism according to an embodiment of the present invention.
Figure 3B:
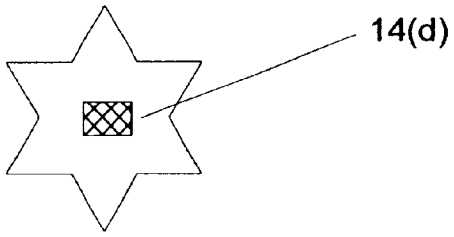

In FIG. 3(*a*), the securing mechanism comprises Velcro™ (i.e., a hook and loop fastener) and includes first and second parts 14(*c*) and (*d*). As shown in FIG. 3(*b*), the second part of the securing mechanism 14(*d*) is attached to the back of each of the garment pieces 12. The first part of the securing mechanism 14(*c*) is affixed to the garment 10 through any available means (e.g., sewing, taping, etc.), or it may be integrated as part of the garment 10.

Figure 6A:
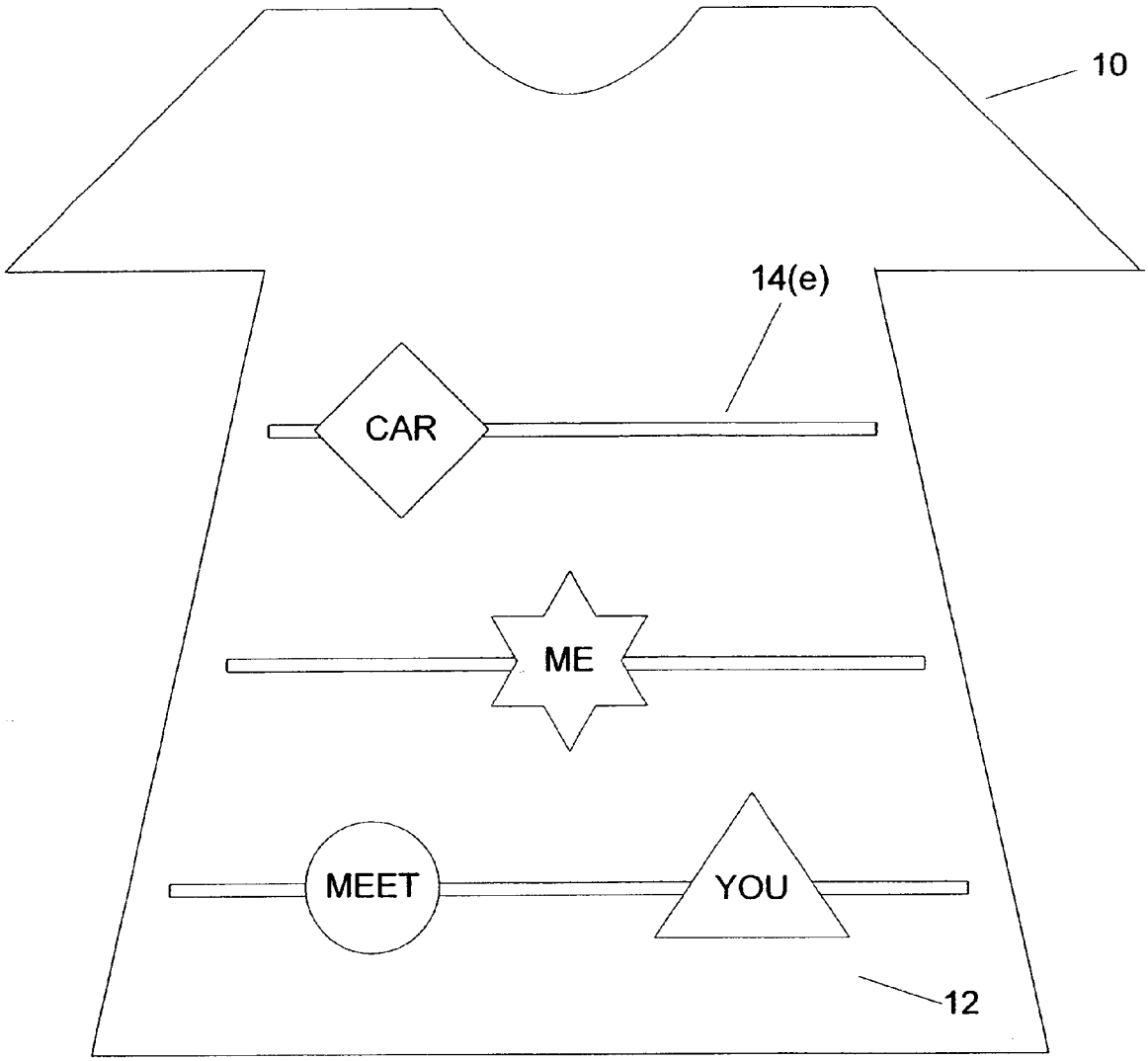
FIGS. 6(*a*)–6(*b*) depict a garment containing removable garment pieces and a garment piece having part of a securing mechanism according to an embodiment of the present invention.
Figure 6B:
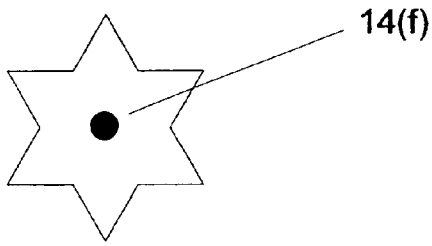

Referring to FIGS. 6(*a*) and 6(*b*), an alternative method of adhering the garment pieces 12 to the garment 10, is through magnets. In one particular embodiment, the securing mechanism is comprised of metal strips 14(*e*) which are affixed to the garment 10 through any available means (e.g., sewing, taping, etc.) or integrated as part of garment 10 and magnets 14(*f*) which are individually affixed to the back of the garment pieces 12 as shown in FIG. 6(*b*). One skilled in the art recognizes that this is only one possible embodiment for using magnets to temporarily adhere the garment pieces to the garment. Other methods fall within the scope of this embodiment.

Figure 7:
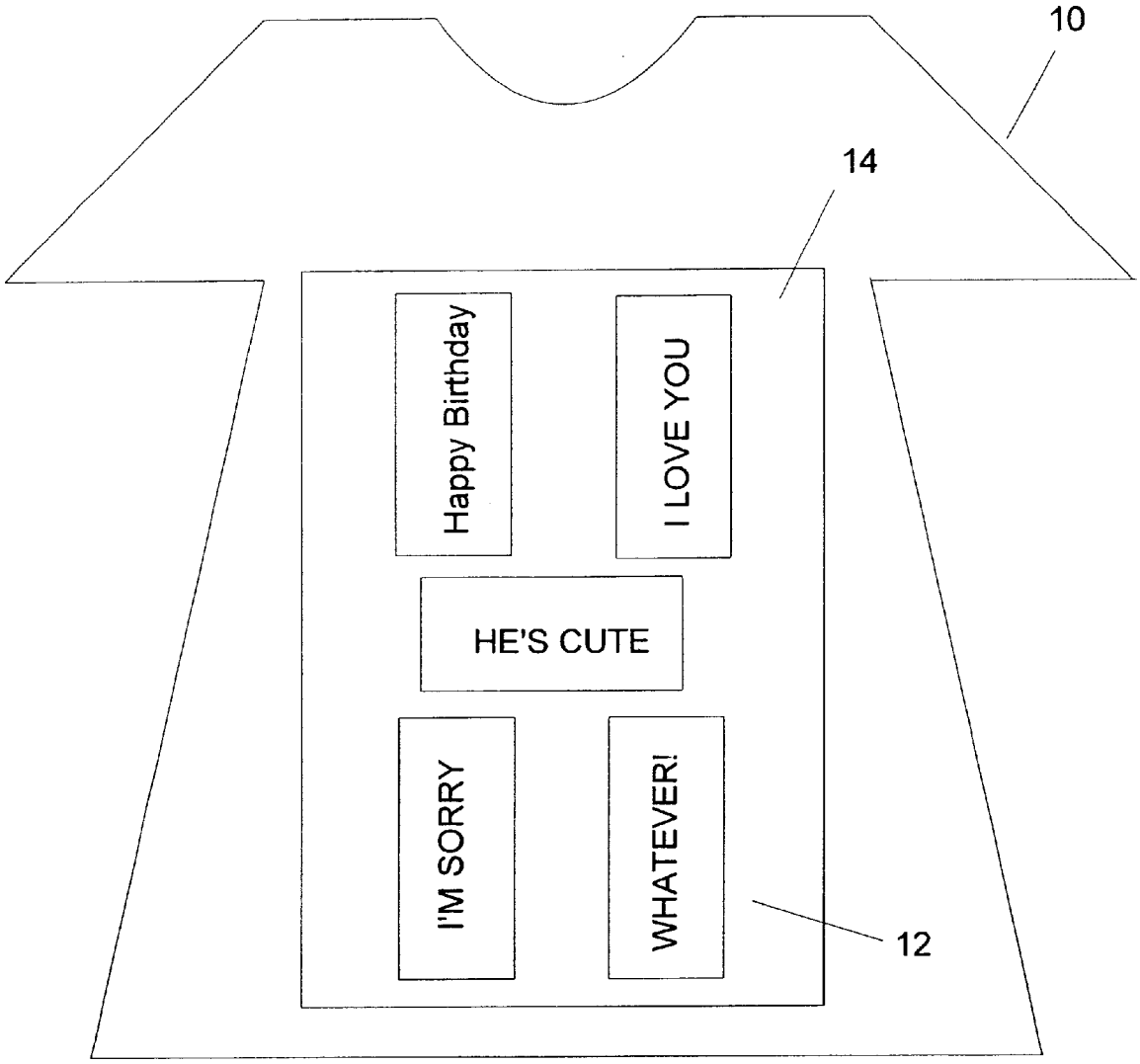
FIG. 7 depicts a garment containing removable garment pieces according to an embodiment of the present invention.

Referring to FIG. 7, the securing means 14 comprises plastic or a similar material panel having semi-permanent adherent qualities based in electrostatics. In FIG. 7, the panel is integral to or affixed to the garment through any available means (e.g., sewing, heat, etc.) and the garment pieces 12 formed of the same material as the panel can be removed and re-adhered to the panel using the electrostatic forces that exist between the electrostatically charged material. By way of example, Colorforms™ utilize this type adhesion.

Consequently, the garment pieces described with reference to FIGS. 2(*a*), (*b*), 3(*a*), (*b*), 6(*a*), (*b*), and 7 can be traded or shared between individuals wearing the communication garment(s) and can be reattached to another communication garment having the same temporary securing mechanism to which a traded or shared garment piece can be attached.

Figure 4:
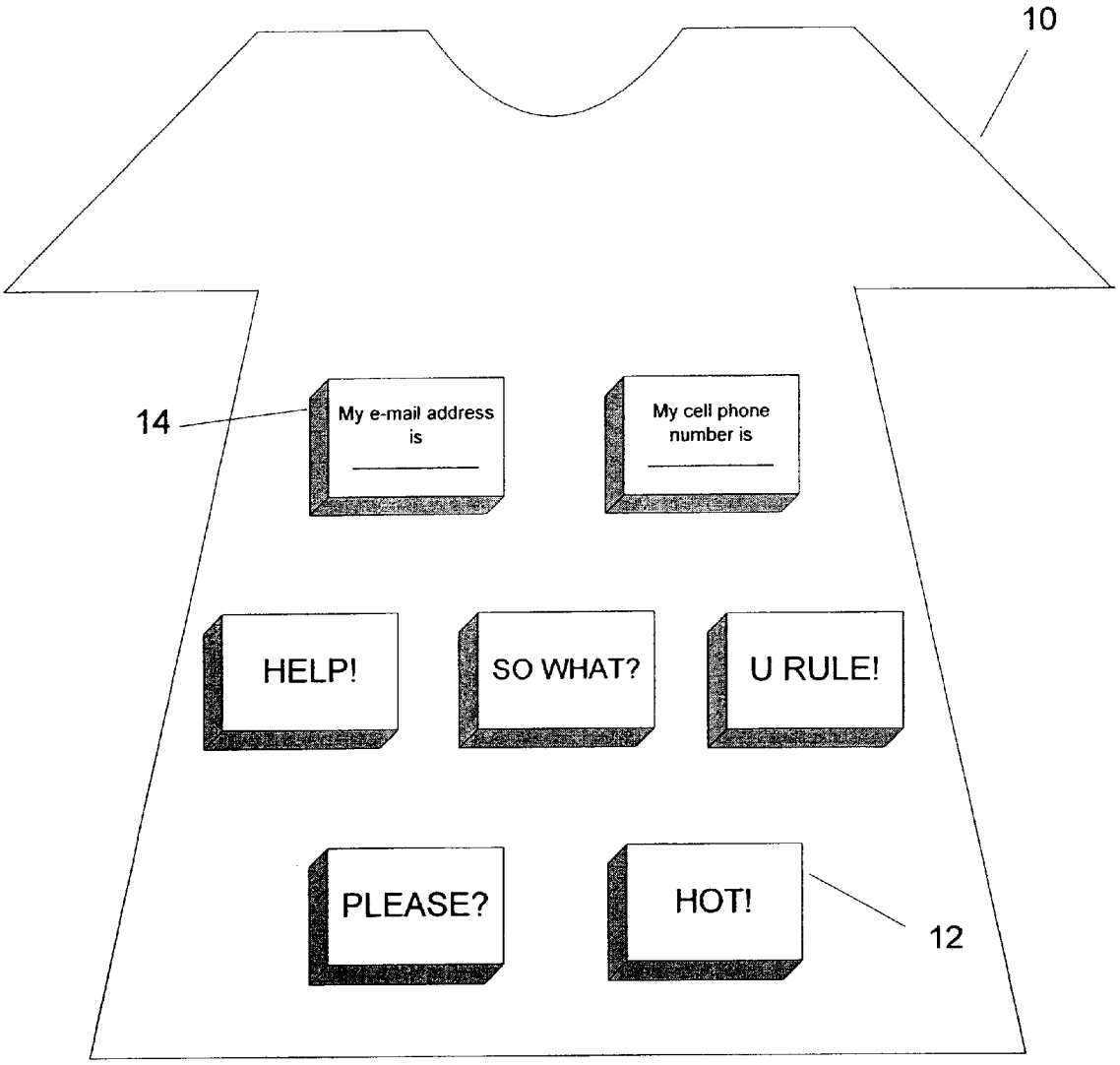
FIG. 4 depicts a garment containing removable garment pieces according to an embodiment of the present invention.

Referring to FIG. 4, in a third embodiment, a communication garment, formed of either disposable or known textile materials, contains removable garment pieces which are disposable. The garment pieces are arranged in stacks in a predetermined pattern on the garment. In this particular embodiment, instead of one removable garment piece per location, the removable garment pieces are stacked, one on top of another, and are each connected, yet separately removable one from another, using an adhesive. As described above, temporary adhesives include pressure-sensitive adhesives such as tackified rubber adhesives, such as natural rubber, olefins, silicones, polyisoprene, polybutadiene, polyurethanes, styrene-isoprene-styrene and styrene-butadiene-styrene block copolymers, and other elastomers; and tackified or untackified acrylic adhesives such as copolymers of isooctylacrylate and acrylic acid, which can be polymerized by radiation, solution, suspension, or emulsion techniques. Crosslinked adhesives are preferred, especially those pressure-sensitive adhesives crosslinked to give high shear strengths. The most preferred adhesives are those that are crosslinked by radiation with or without a chemical crosslinking agent. Such adhesives that have high shear strength provide low debonding force and can easily be removed when stretched.

In any of the embodiments described above, the garment pieces can include Braille messages, in order to facilitate communication in the case of blindness.

In the embodiments described above, there is no limit as to the color or combination of colors of the garment and/or the garment pieces. The garment pieces are also unlimited in shape. The garment pieces can be shaped as hearts, stars, circles, rectangles, and the like. Further, the garment is not limited to a shirt. Any garment, such as a hat, jacket, vest, or the like, may also be used to communicate through the garment pieces.

Figure 5:
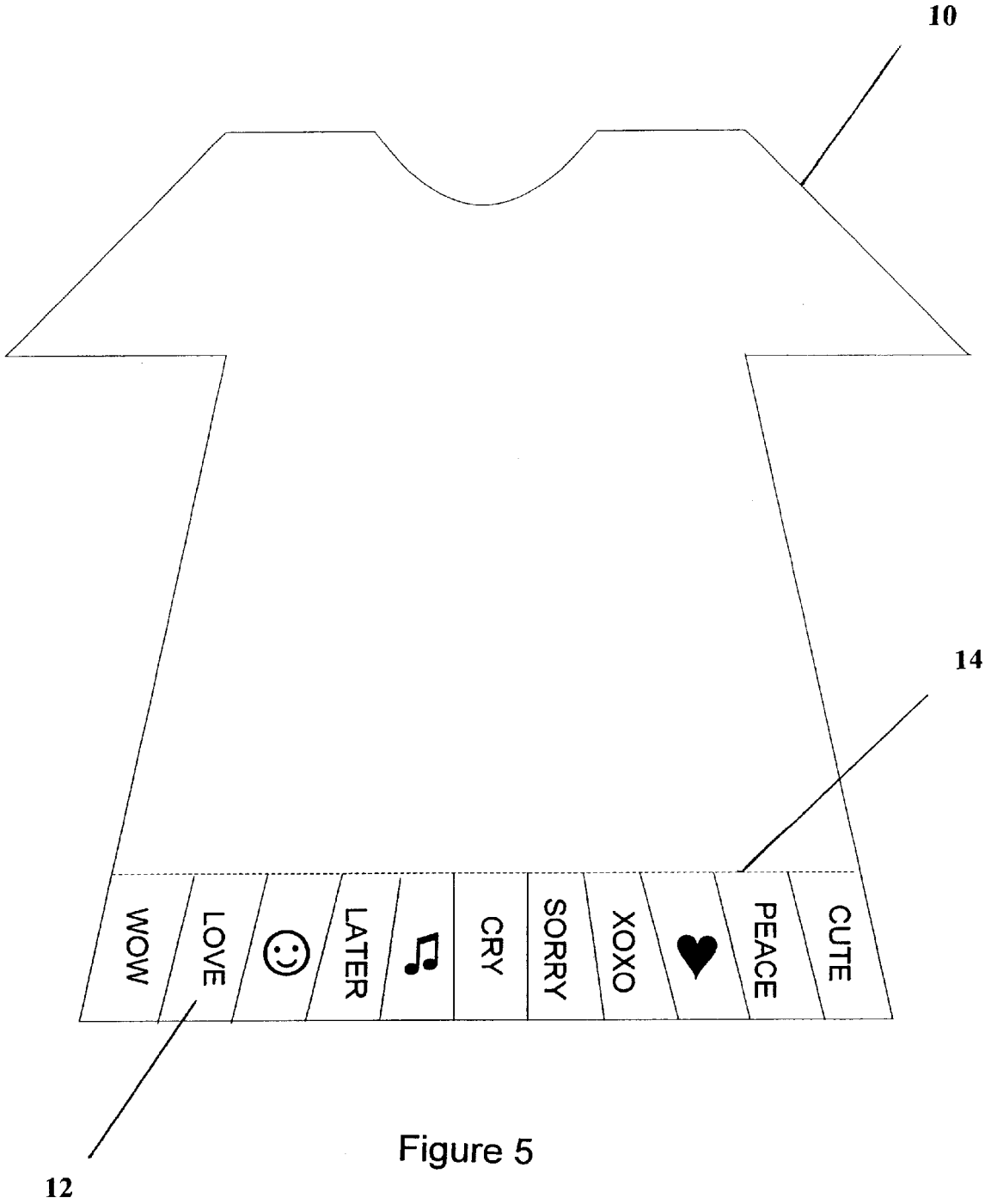
FIG. 5 depicts a garment containing removable garment pieces according to an embodiment of the present invention.

In further embodiments of the present invention, the garment pieces may be arranged or located in any pattern or location on the garment. For example, the garment pieces can be suspended from the bottom of the garment as shown in FIG. 5 as opposed to or in addition to being located within the body of the garment.

In further embodiments of the present invention, the garment pieces are seasonal, wherein the garment pieces contain holiday messages such as "Merry Christmas," "Happy Hanukkah," "Happy Valentines Day," and "Happy New Year." For Halloween, Easter, Christmas, Valentine's Day, St. Patrick's Day, Forth of July, Hanukkah, for example, the garment pieces contain messages and pictures indicative of the holiday and/or time of year.

In further embodiments of the present invention, the garment pieces are sports or entertainment related, wherein the garment pieces contain names and/or pictures of professional sports players, professional sports teams, musicians, actors, etc.

Finally, the garment pieces may be blank, such that the garment pieces may be written or drawn on before or after removal and/or reattachment.

One skilled in the art recognizes the many variations of the embodiments described above which remain within the scope of the invention. The embodiments described herein are not intended to be limiting.

We claim:

1. An article for communicating at least one message comprising:

a garment;

at least one detachable message having multiple sides; and a securing mechanism for detachably attaching the at least one detachable message to the garment, wherein the securing mechanism is a perforated segment between the garment and one of the multiple sides of the detachable message, such that the remaining multiple sides of the detachable message are not attached to the garment, and further wherein the detachable message is formed of the same material as the garment.

2. The article according to claims 1, wherein the garment is formed of a disposable material.

3. The article according to claim 2, wherein the disposable material is paper.

4. The article according to claim 1, wherein the garment is a shirt.

5. The article according to claim 1, wherein the garment is a hat.

6. The article according to claim 1, wherein the garment is a vest.

7. The article according to claim 1, wherein the garment is a jacket.

8. The article according to claim 1, wherein the at least one detachable message is in the shape of a heart.

9. The article according to claim 1, wherein the at least one detachable message is in the shape of a star.

10. The article according to claim 1, wherein removal of the at least one detachable message results in a hole in the garment having the shape of the at least one detachable message.

11. The article according to claim 1, wherein removal of the at least one detachable message reveals a layer of material having the shape of the at least one detachable message that is connected on all sides to the garment in order to maintain the integrity of the garment upon removal of the at least one detachable message.

12. The article according to claim 1, wherein the garment and the at least one detachable message are formed from the same piece of material.

13. An article for communicating at least one message comprising:

a garment;

at least one detachable message, wherein the at least one detachable message is selected from a group of multiple detachable messages which are detachably attached to the garment, and further wherein the group of multiple detachable messages are stacked one on the other and are detachably adhered to the garment and to one another through one of a rubber or acrylic adhesive; and a securing mechanism for detachably attaching the at least one detachable message to the garment.

14. The article according to claim 13, wherein the multiple detachable messages are formed of a disposable material.

15. The article according to claim 13, wherein the garment is formed of a disposable material.

16. The article according to claim 13, wherein the garment is formed of a non-disposable material.

17. An article for communicating at least one message comprising:

a garment;

at least one detachable message; and a securing mechanism for detachably attaching the at least one detachable message to the garment, wherein the securing mechanism is a perforated segment between the garment and one of the multiple sides of the detachable message, and further wherein the at least one detachable message and the garment are formed from the same piece of material.

* * * * *